United States Patent [19]

Foret

[11] Patent Number: 4,715,435

[45] Date of Patent: Dec. 29, 1987

[54] DUAL PUMP FOR TWO SEPARATE FLUIDS WITH MEANS FOR HEAT EXCHANGE BETWEEN THE FLUIDS

[76] Inventor: Claude H. Foret, 7122 Jordan Ave., Apt. 7, Canoga Park, 91303

[21] Appl. No.: 836,759

[22] Filed: Mar. 6, 1986

[51] Int. Cl.[4] ..... F04B 43/12; F28F 7/00

[52] U.S. Cl. ..... 165/120; 417/475; 417/477

[58] Field of Search ..... 165/120, 1; 126/247; 417/475, 477

[56] References Cited

U.S. PATENT DOCUMENTS

| | | | |
|---|---|---|---|
| 1,335,672 | 3/1920 | Du Noüy | 417/477 |
| 2,722,893 | 11/1955 | Maillot | 417/475 |
| 3,138,111 | 6/1964 | Kling et al. | 417/477 X |
| 3,211,645 | 10/1965 | Ferrari | 417/475 X |
| 3,229,643 | 1/1966 | Roudaut | 417/475 |
| 3,475,128 | 10/1969 | Thiers | 417/477 X |
| 3,523,000 | 8/1970 | Miller | 417/477 |
| 3,823,559 | 7/1974 | Foret | 60/508 |
| 3,862,780 | 1/1975 | Senn | 417/477 X |
| 4,044,824 | 8/1977 | Eskeli | 165/88 |
| 4,165,954 | 8/1979 | Amos | 417/477 |
| 4,392,794 | 7/1983 | Foxcroft | 417/477 X |
| 4,482,347 | 11/1984 | Borsanyi | 604/153 |
| 4,529,106 | 7/1985 | Broadfoot et al. | 417/475 X |

FOREIGN PATENT DOCUMENTS

| | | | |
|---|---|---|---|
| 2400456 | 7/1975 | Fed. Rep. of Germany | 417/477 |
| 118704 | 6/1959 | U.S.S.R. | 417/475 |

*Primary Examiner*—Albert W. Davis, Jr.

[57] ABSTRACT

A method and apparatus for pumping and exchanging heat at an accelerated rate between two fluid streams. The apparatus comprises opposite peristaltic pumps moving a separate fluid on their respective side of a linear heat-conductive platen. Each pump consists of a flat elastomeric diaphragm clamped by its edges on the platen; the clamping squeeze displaces the elastomer and makes the diaphragm bulge. Closely spaced pins in combination with fixed cams, flatten and contract the bulge across to form a variable cross-section working chamber. Inlet and outlet are formed by the elastomer bulging into end block cavities leading to ports. In a typical operation, conveyed rollers depress the pins which in turn completely contract the bulge to sealing contact with the platen and form shrinking volumetric chambers, wherein a gas or mixed-phase fluid is compressed progressively on one side of the platen; on the other side similar operation occurs but volumetric chambers circulate a non-compressible liquid. During operation, heat of compression is simultaneously rejected to the cooling liquid through the platen to achieve a near-isothermal process.

15 Claims, 7 Drawing Figures

DUAL PUMP FOR TWO SEPARATE FLUIDS WITH MEANS FOR HEAT EXCHANGE BETWEEN THE FLUIDS

BACKGROUND

This invention relates to heat exchangers using peristaltic pumps to circulate a separate fluid on opposite sides of a heat-conductive wall and enhance heat transfer rates between the fluids. In the prior art there are many types of peristaltic pumps; Bogachev U.S.S.R., Pat. No. 118704 discloses a pump using an elastic casing squeezed from opposite sides by spherical rollers whereby the casing is extended to sealing contact, generating a peristaltic pumping action; in a second version, cylindrical rollers deflect a double-convex casing to sealing contact but also spreads the casing laterally: This is unlike the invention; in Bogachev's patent there is no possibility of heat-exchange between two fluids. Other peristaltic pumps roll-down a flexible tubing or deform it rythmically with cam-actuated fingers to move a fluid, substantially unlike the invention. Peristaltic pumps also generally have high running friction, short life of the elastomer and low speed and pressure output, deficiencies substantially overcome by the invention. Heat exchangers are not known to use peristaltic pumps and most often are passive elements where fluids must be circulated by outside means; also heat transfer rates suffer by incomplete turbulence of the fluids. Peristaltic pumping of the invention substantially overcomes these deficiencies.

SUMMARY OF THE INVENTION

Running rollers deflect a linear diaphragm to sealing contact with a heat-conductive platen and form moving volumetric chambers between rollers. A primary fluid is circulated on one side of the platen; similarly a secondary fluid is circulated on the other side. Heat is transferred thru the platen between the fluids. Each pump features a flat elastomeric diaphragm which is being made to bulge by increasing its width by the squeezing of its edges, forming the working chamber. Pins in combination with fixed cams provide a deformable structural ceiling for the diaphragm and shape the working chamber. During operation, the rollers deflect the pins which in turn flatten and contract the diaphragm to sealing contact with the platen. When released from the sealing contact, the diaphragm resiliently bulges away from the platen to produce a vacuum and fill the chamber. One object of the invention is to improve on prior art peristaltic pumps by providing lower rolling friction, lower wear, higher speed and pressure output.

Another object of the invention is to improve on prior art heat exchangers by providing an accelerated rate of heat transfer, yet integrating means of pumping processed fluids at the same time.

Another object is the ability of handling gases and two-phase fluids, compressing or expanding them at variable rates, while exchanging heat, to achieve improved thermodynamic cycles.

Finally to make this invention simple, easy to fabricate and low in cost.

DRAWINGS

Figure 1:
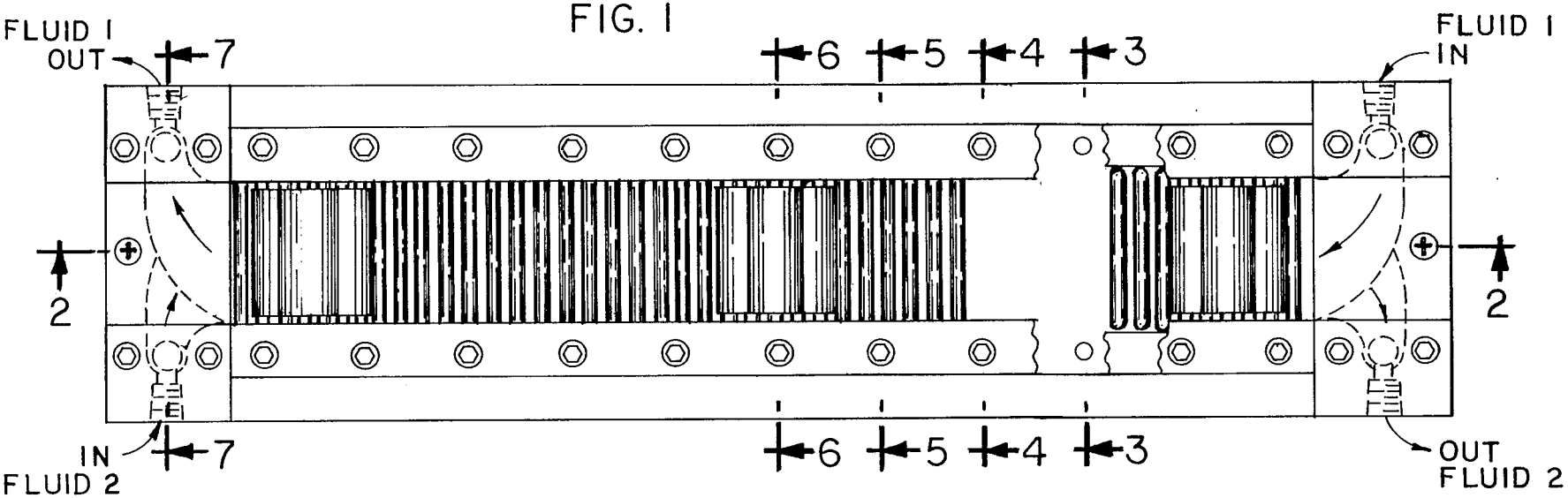
FIG. 1 is a plane view of a form of heat exchanger according to the invention.

FIG. 3 thru FIG. 7 are magnified cross-sectional views taken respectively along line 3—3 thru 7—7 of FIG. 1.

DETAILED DESCRIPTION

Figure 2:
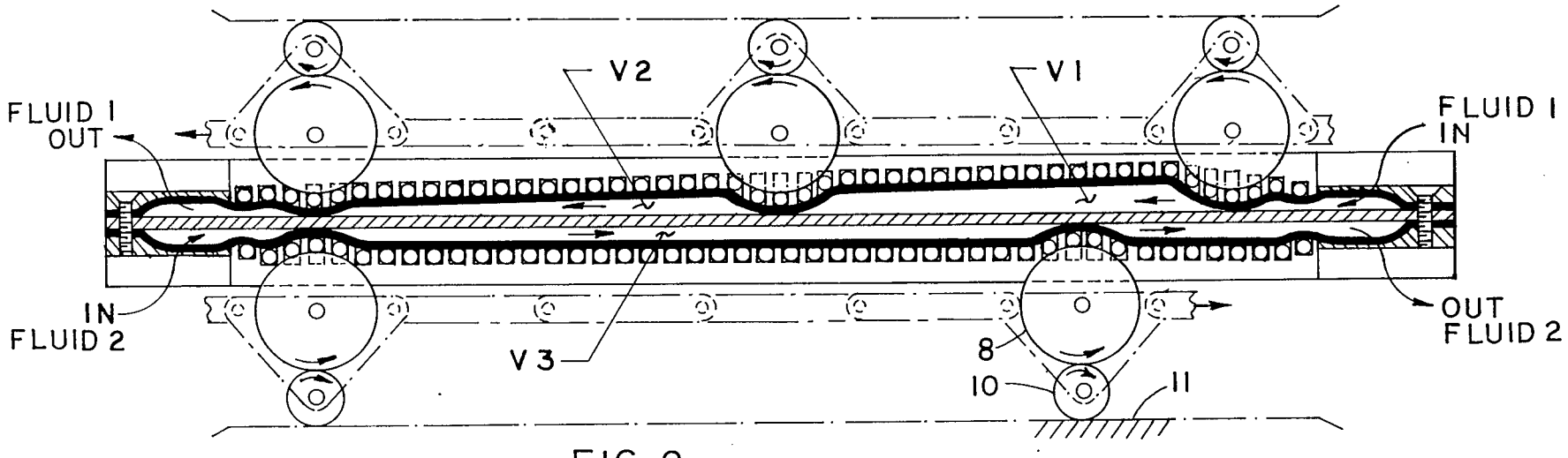
FIG. 2 is a cross-sectional view taken along line 2—2 of FIG. 1.
Figure 3:
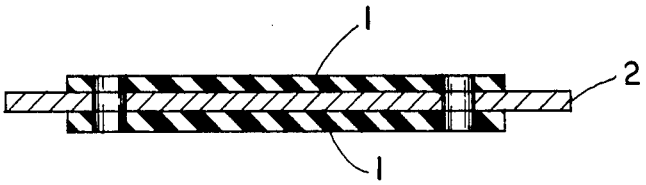
Figure 4:
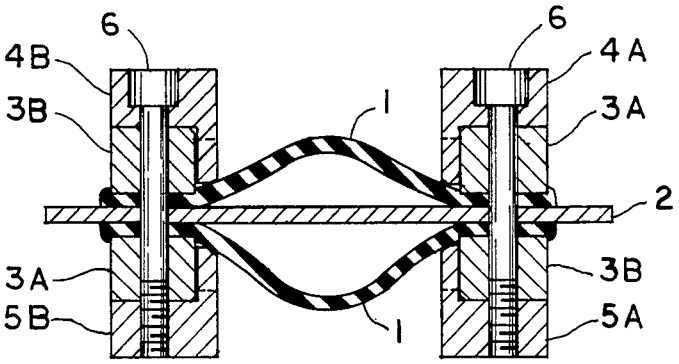
Figure 5:
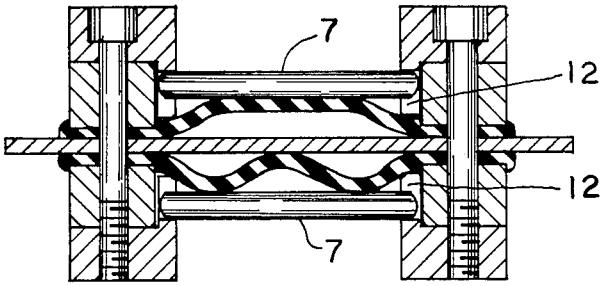
Figure 6:
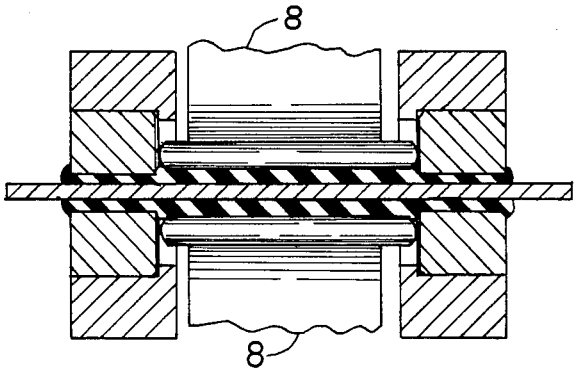
Figure 7:
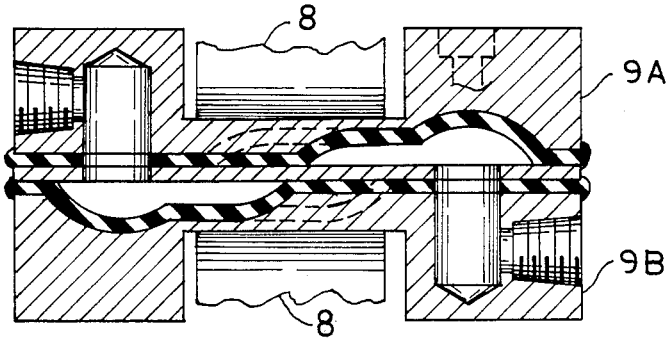

FIG. 3 thru FIG. 7 illustrate the building steps of a form of the invention. Referring to FIG. 3, flat elastomeric diaphragm 1 is laid on both sides of a heat-conductive platen 2. In FIG. 4 clamp bars 3A, 3B and cam bars 4A, 4B, 5A, 5B are installed as shown and fastened with screws 6. As the screws are tightened the clamp bars exert pressure on the diaphragm edges displacing some of the elastomer outside the clamping area, thus increasing the effective width of the diaphragms and making each diaphragm bulge. This forms, with the platen, two conduits along the linear extent of said platen. The diaphragm material is a hard elastomer preferably of the "Elastoplastics" type such as polyurethane, copolyester, or even the softer plastics such as the fluoroplastics, in the preferred hardness range of 90A to 55D. Both diaphragms should be of the same durometer but to illustrate an example in FIG. 4, the upper diaphragm is harder than the lower one; under the clamping pressure the lower diaphragm will have more elastomer displaced than the upper one and consequently the lower bulge will be greater than the upper one. In FIG. 5, pins 7 are added, they are missing in FIG. 4 to show the free bulging of the diaphragm, but should be installed at the same time as clamp bars and cam bars. The cam bars have closely spaced slots 12 of varying depth which guide and retain the pins. During assembly the pins flatten and shrink the bulge to a variable distance from the platen. This distance or working stroke is a small percentage of the free bulge height. For the harder upper diaphragm the bulge is simply flattened and shrunk. For the softer lower diaphragm the bulge top collapses and forms a multi-node shape. In FIG. 6, running rollers 8 deflect the pins which in turn depress the diaphragm to sealing contact with the platen. The diaphragm springs back or bulges behind the rollers, thus causing a suction or vaccum which fills the pumping chamber formed thereby, and thus renders the pump self-priming and capable of continuous pumping without the requirement of positive pressure on the fluid at the inlet. The softer diaphragm although multinode reduces the area or lumen of the working chamber, it provides for a strong spring-back and a consequent strong suction. In FIG. 7, end blocks 9A and 9B are closing both ends and both sides of the assembly to establish inlets and outlets by letting the diaphragm expand in cavities leading to ports. In FIG. 2, showing a length-wise cross-section of the invention, it can be seen that the fluid 1 working chamber is tapered from the inlet to the outlet: This is determined by the cam bar slots which are guiding and retaining the pins. Change in the depth of the cam bar slots will produce a different working chamber shape. Fluid 2 working chamber is uniform. It is now particularly called to attention that one feature of the invention is to use a low-cost flat diaphragm that can be made to bulge to form the working chamber and furthermore, in combination with pins and cams, that the working chamber can be shaped to any configuration, especially important for the process of gases to obtain various volumetric ratios and pressure curves. It can be seen that under the roller action the diaphragm flattens and shrinks completely to sealing contact with the platen without spreading out laterally but gets slightly thicker than the original thickness in the process, because of the contraction. Equally spaced rollers 8 with reaction rollers 10 form part of a conveyor system with drive and idle sprockets, including a reaction track 11, adjustable to position the rollers for correct occlusion of the diaphragm; as this is known technology, it is not fully shown. A separate conveyor running in opposite direction is used for each fluid to increase the heat transfer by the well known counter flow principle. Another advantage of diaphragm, pins and cams combination is a lower rolling friction and lower wear due to the interrupted progression of the diaphragm squeeze by separated pins: this allows the overoccluded elastomer to expand between pins rather than to extrude under the roller. It also eliminates the "fold effect" which a roller produces on a flexible tubing and which makes the tubing creep ahead of motion; since the tubing end is fixed, the creep length must be swallowed by extrusion under the roller and results in added friction. The invention decouples roller from elastomer to avoid the "fold effect". The pins provide a strong ceiling for the diaphragm and with a low dynamic elastomer deformation the result is that speed and output pressure are higher than usual peristaltic pumps. Most importantly, heat transfer is maximized because of high velocity, hydrodynamic effect and full fluid turbulence by the rolling action. A typical operation is shown in FIG. 2. Running rollers progressively flatten a portion of the elastomer along the linear extent of the platen to produce moving volumetric chambers. Gaseous fluid 1 is inducted into an enlarging chamber until the next roller blocks the inlet and a volume VI is trapped; because of the shape of the working chamber, determined by the cams and pins combination, volume VI is compressed until roller opens the outlet at volume V2 achieving a compression ratio of V1/V2. Similarly on the other side a fluid 2, now a liquid, enters the enlarging chamber until next roller traps the liquid at volume V3. The volumetric chamber is now kept parallel by the cams and pins combination so as not to compress a liquid; volume V3 is circulated until roller opens the outlet and squeezed out. Fluid 1 and 2 move in opposite directions to each other for counterflow advantage. During operation heat of compression is rejected to the cooling liquid to achieve a near-isothermal process. The invention is reversible; a compressor can be made an expander by feeding compressed gas at the former compressor outlet; in an action opposite to the compressor, compressed gas will be expanded in the now expanding working chamber while the diaphragm will transmit gas pressure to the roller for motor action, so the expander will move in a direction opposite to the compressor. Heated liquid can be used to heat the expanding gas near-isothermally and increase the work output such as in heat engine application, or the liquid can be cooled by the expanding gas in heat pump application. Although not shown, it is within the scope of this invention to expand the present embodiment into a heat pump or heat engine based on the Stirling or similar cycles. The Stirling heat engine cycle uses these processes in succession: isothermal compression (cooled)-constant-volume (heated)-isothermal expansion (heated)-constant-volume (cooled). All these processes are nearly achievable in the invention by modulating the working chamber with the pins and cams combination, at the same time providing the required cooling or heating. Heat engine may be especially well adapted to work with low-grade temperature heat sources such as solar energy and working gas may be a two-phase refrigerant. The invention described can also be arranged in obvious other configurations from straight linear to cylindrical linear or annular linear. The annular linear embodiment would have a compact size for lighter applications; it could use orbiting conical rollers carried by spiders rather than the larger size conveyor system. The cylindrical linear configuration would also use orbiting rollers, arranged inside and outside the cylinder, carried by spiders in the general manner suggested by the said U.S.S.R. disclosure, either with or without the roller equalizing means therein shown. In all modifications the linear paths of straight or annular or cylindrical would have a corresponding linear path for the pumping conduits. The term "pump" as used herein also includes "motor" since the same structure operating in the same way will extract, as well as add, energy to a fluid stream.

I claim:

1. A self-priming conduit comprising a base platen having a width defined by edges and a linear extent, an elastomeric diaphragm sealed and secured to said edges, the width of the elastomeric diaphragm being greater than the width of said platen in the amount that the diaphragm will bulge when released to produce a space between the platen and the diaphragm, said width, thickness, and material of said diaphragm being also such that when the diaphragm is forced into contact with said platen, the diaphragm will compress without folding, but will bulge to produce a self-priming suction when released.

2. The conduit of claim 1 wherein said diaphragm is secured and sealed to the platen by means comprising a clamping member overlying at least one of said edges and clamping the corresponding edge of said diaphragm therebetween, and means to vary the clamping pressure of said member to vary the effective width of said diaphragm.

3. The conduit of claim 1 further including an inlet and outlet, and means for progressively forcing a portion of said diaphragm along said linear extent into proximity of said platen, thereby constituting a peristaltic pump for a fluid.

4. The peristaltic pump of claim 3 wherein said platen has a second side, a second elastic diaphragm secured at its edges to said second side to form a second conduit, there being an inlet and an outlet for said second conduit, said first named inlet and outlet being connectable, respectively, to an external source and destination of a first fluid, and said last named inlet and outlet being connectable, respectively, to a separate, external, source and destination of a second separate fluid.

5. The pump of claim 4 wherein the second diaphragm is of the type which will also bulge and compress with no folding when forced into contact with said platen, and means for progressively forcing a portion of said second diaphragm into proximity of said platen along said linear path to produce a second peristaltic pump for a second fluid.

6. The pump of claim 3 wherein said means for progressively forcing said portion of said conduit comprises a series of pins extending along said path arranged for movement between said bulged and said compressed positions of said diaphragm, and means to progressively produce movement of said pins along said path.

7. The pump of claim 4 wherein said means for progressively forcing both of said diaphragms comprises a series of pins along said path arranged for movements between said bulged and said proximity positions, and means for progressively moving said pins along said path between said positions.

8. The pump of claim 4 wherein said platen is of a heat transmitting type, said sources being of differing temperatures, thus producing a heat exchange between said fluids as they are moved through said conduits.

9. The pump for first and second fluids of claim 5 wherein said platen is of a heat transmitting character, thus producing a dual pump for two separate fluids with heat exchange between said fluids.

10. The heat exchanging pump of claim 9 wherein the second pump moves said second fluid along said path in a direction opposite to the motion of said first fluid, thus enhancing said heat exchange.

11. The dual fluid heat exchanging pump of claim 9 wherein the bulged portion of said first fluid progressively diminishes in size along said path.

12. A heat exchanging pump for two separate fluids, comprising a platen extending along a linear path, a bulged diaphragm secured at its edges to the edges of said platen to provide therewith a conduit, means to progressively compress a portion of said diaphragm against said platen along said path to constitute a peristaltic pump, and a second conduit including the opposite side of said platen, said platen being of a heat transmitting character, there being an inlet and an outlet for said first mentioned conduit connectable to a source and destination respectively, of the first of said fluids, and an inlet and outlet for said second conduit, connectable to a source and destination, respectively, of the second of said fluids, separate from said first fluid.

13. The pump of claim 12 wherein said second conduit includes a second bulged diaphragm secured at its edges to the opposite side of said platen, and a second means to progressively compress a portion of said second diaphragm against said platen along said path, to constitute a dual pump for said separate fluids.

14. A method of exchanging heat between two fluids of differing temperatures, comprising passing a first fluid of one temperature through a peristaltic pump conduit having a diaphragm secured at its edges to a heat conducting platen extending along a linear path, passing a second fluid of a different temperature through a second conduit which includes the opposite side of said platen, progressively compressing a portion of said diaphragm along said path to produce said passing of said first fluid and to cause turbulence at said portion to enhance heat conduction between said fluids.

15. The method of claim 14 wherein said second conduit includes a second diaphragm secured at its edges to said platen, said method including the further step of progressively compressing said second diaphragm along said path to pump and cause turbulence of said second fluid.

* * * * *